US006659418B2

(12) United States Patent
Lemire

(10) Patent No.: US 6,659,418 B2
(45) Date of Patent: Dec. 9, 2003

(54) POSITIONING & LOCKING HANGING SYSTEM

(76) Inventor: Robert Lemire, P.O. Box 299, Kings Park, NY (US) 11754

( * ) Notice: Subject to any disclaimer, the term of this patent is extended or adjusted under 35 U.S.C. 154(b) by 0 days.

(21) Appl. No.: 09/900,602

(22) Filed: Oct. 2, 2001

(65) Prior Publication Data

US 2002/0033437 A1 Mar. 21, 2002

Related U.S. Application Data

(62) Division of application No. 09/339,661, filed on Jun. 24, 1999, now Pat. No. 6,279,257.

(51) Int. Cl.[7] ..... A47G 1/16
(52) U.S. Cl. ..... 248/495; 248/476; 40/757
(58) Field of Search ..... 248/476, 477, 248/489, 495, 496, 222.13, 316.2, 222.14, 229.11, 231.13, 229.12, 231.41, 475.1, 478; 40/757, 759

(56) References Cited

U.S. PATENT DOCUMENTS

| | | | | | |
|---|---|---|---|---|---|
| 2,975,994 | A | * | 3/1961 | Goss | 248/478 |
| 3,252,236 | A | * | 5/1966 | Davis | 248/475.1 |
| 3,612,469 | A | * | 10/1971 | Dennis | 248/221.11 |
| 3,636,669 | A | * | 1/1972 | Atkisson | 52/38 |
| 3,895,775 | A | * | 7/1975 | Norton | 248/476 |
| 4,041,793 | A | * | 8/1977 | Repay et al. | 74/424.78 |
| 4,069,998 | A | * | 1/1978 | Rytting | 248/225.21 |
| 4,385,744 | A | * | 5/1983 | Sherman et al. | 248/551 |
| 4,684,094 | A | * | 8/1987 | Everett | 211/187 |
| 4,712,761 | A | * | 12/1987 | Wassell | 248/220.1 |
| 4,858,351 | A | * | 8/1989 | Sewell et al. | 248/489 |
| 4,892,284 | A | * | 1/1990 | Kelrick | 248/476 |
| 5,050,324 | A | * | 9/1991 | Casull | 16/364 |
| 5,138,780 | A | * | 8/1992 | Kunkel | 40/765 |
| 5,276,984 | A | * | 1/1994 | Burns | 40/757 |
| 5,806,826 | A | * | 9/1998 | Lemire | 248/476 |
| 5,878,987 | A | * | 3/1999 | Hayde | 248/477 |
| 5,931,439 | A | * | 8/1999 | Lemire | 248/476 |
| 5,947,438 | A | * | 9/1999 | Lemire | 248/476 |
| 6,138,968 | A | * | 10/2000 | Svantesson et al. | 248/220.22 |
| 6,241,210 | B1 | * | 6/2001 | Brindisi | 248/476 |
| 6,354,031 | B1 | | 3/2002 | Meur | 40/781 |

FOREIGN PATENT DOCUMENTS

| | | | | | |
|---|---|---|---|---|---|
| JP | 405044289 | A | * | 2/1993 | 52/506.08 |

* cited by examiner

*Primary Examiner*—Ramon O. Ramirez
*Assistant Examiner*—Jon Szumny

(57) ABSTRACT

Picture frames and frame bases attached to pictures that are able to be mounted flush against a wall are described. Special recessed areas and frame connections make contact with one or more special wall brackets. The wall brackets are anchored into the wall and are connected to the frame in a number of ways. One of the ways is with the use of a screw that has a threaded bar moving on it. The screw goes through the top of the frame and is locked to the inside face of the frame so that it remains in place when the screw is turned. When the screw is turned the threaded bar moves into a recess in the wall bracket and pushes the picture up until the picture bottom hits a second wall bracket. This second bracket locks the picture onto the wall. The embodiments presented demonstrate various other means of locking the picture flush against the wall, as well as, means for leveling and adjusting the position of the picture.

2 Claims, 11 Drawing Sheets

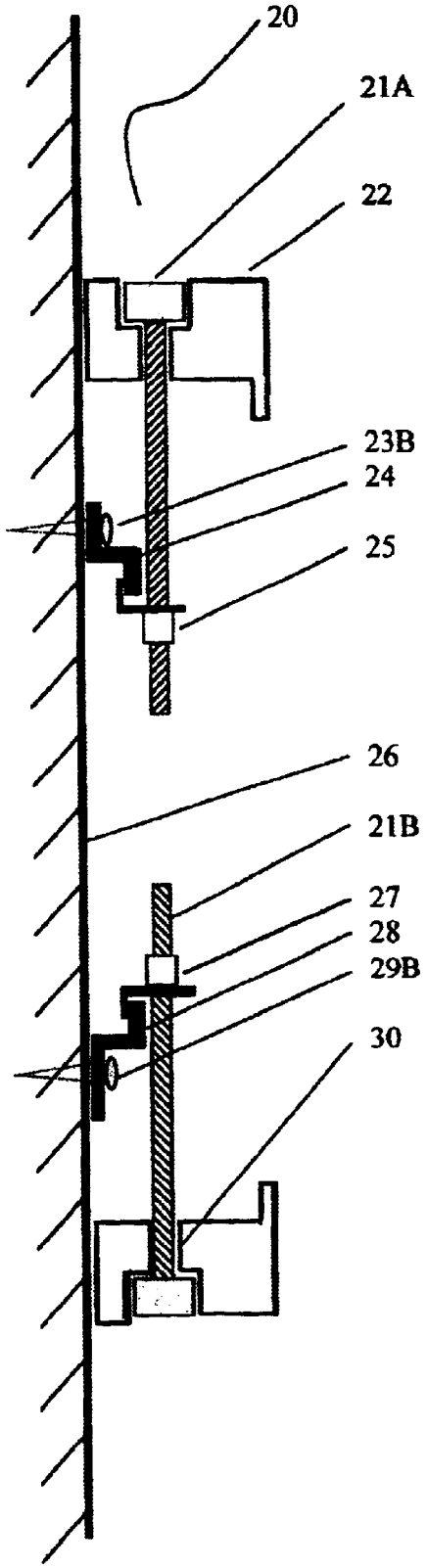
Section A-A
Figure 2-B

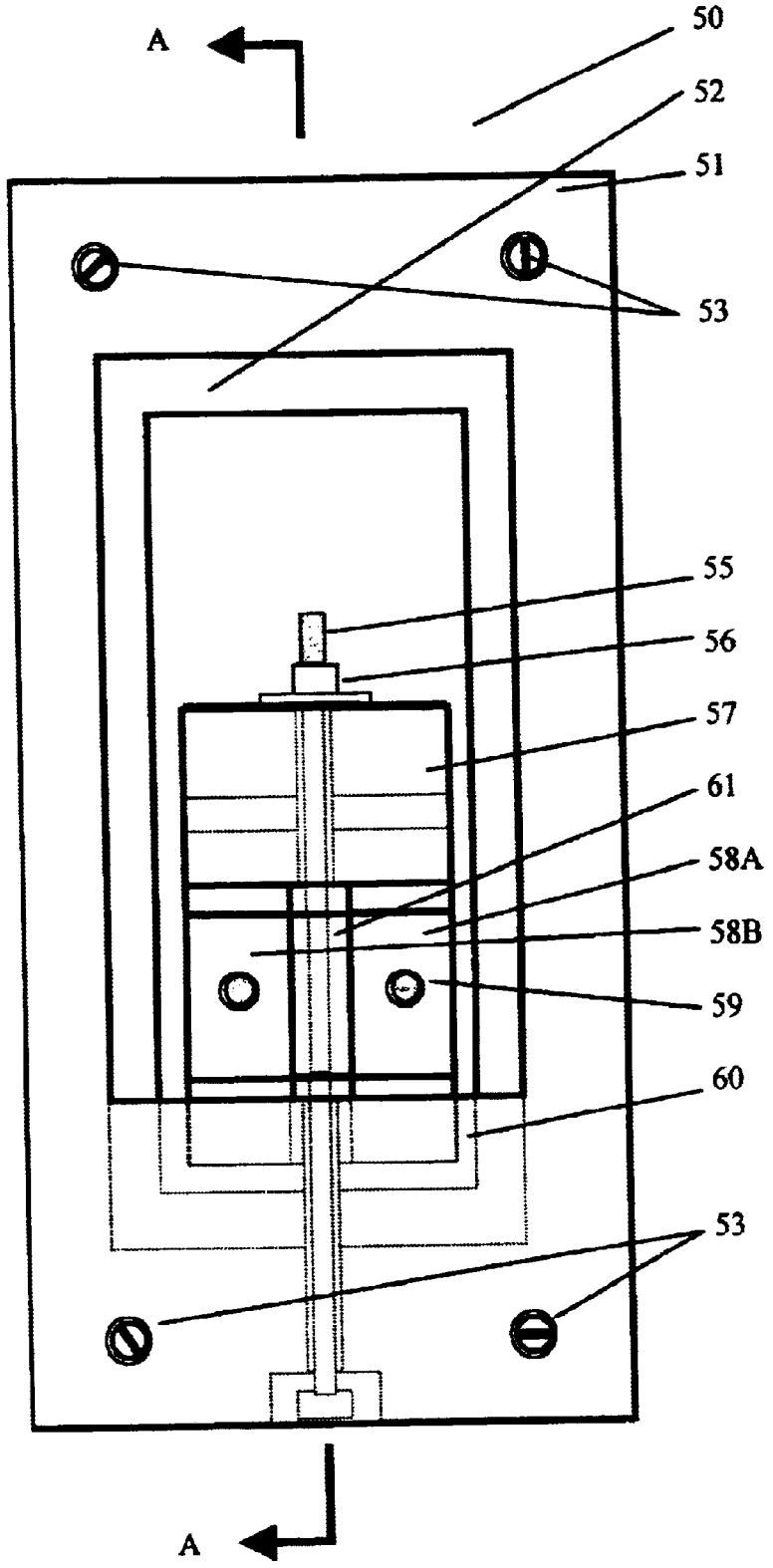
Figure 4-A

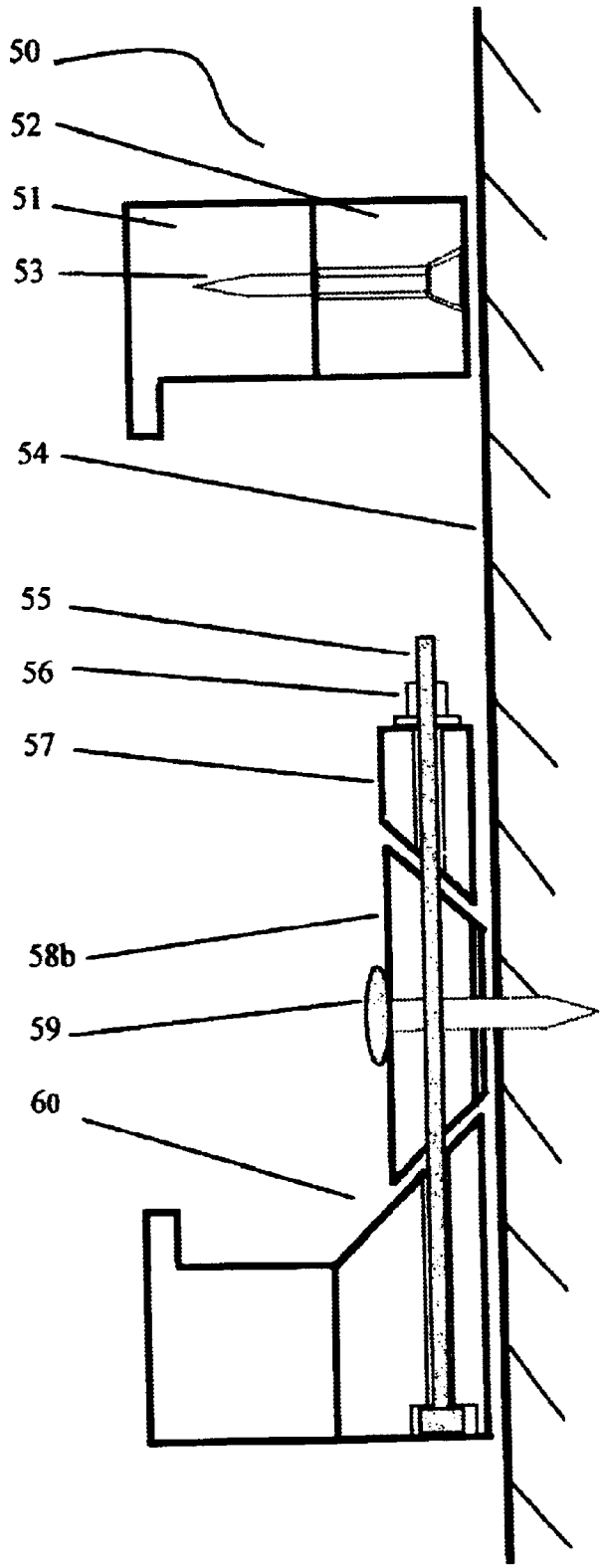
Section A-A
Figure 4-B

Section A-A

POSITIONING & LOCKING HANGING SYSTEM

This application is a division of Ser. No. 09/339,661 filed on Jun. 24, 1999 now U.S. Pat. No. 6,279,257.

FIELD OF THE INVENTION

The invention concerns a customized picture frame base. and devices that are attached onto a wall or other surface to securely support the frame flush against the wall, thereby providing a measure of security against theft. The frame base can be an integral part of the picture frame or be a separate unit that has the picture frame attached to it. The devices that support the frame are anchored into the wall and provide a number of mechanical or electromechanical means for securely engaging the frame. Some wall mounting brackets also incorporate a measure of adjustability on the position of the picture on the wall.

BACKGROUND OF THE INVENTION

Known security picture hangers in commercial production used for hanging pictures onto walls are not able to hold a picture so that it is flush against the wall. They require a gap for the insertion of a special locking tool. They also lack any significant capability for changing the position of the picture after the picture is attached to them. It is useful to be able to have a picture frame, or picture frame base that is attached to a picture, that can be securely hung flush against a wall. This makes it difficult for a thief to pry the picture off the wall. The incorporation of adjustability allows the picture to be leveled and the center of the picture to be moved to a desired position, sometimes without having to remove the picture from the wall.

SUMMARY OF THE INVENTION

This invention couples frame configurations with the hardware used to support the picture on the wall. The picture frame has a recessed, and sometimes inwardly wedged, back area. This area provides space for the inward frame wedge and for the connections to the supporting hardware affixed to the wall. This allows the picture sides to be held flush against the wall.

Simple screws with threaded T-bars and hooks, electrical devices, and spring latches are some of the means that can be employed for holding the picture in place on the wall. With each of these means comes varying degrees of adjustability for the picture.

One or more screws can be placed in the top, bottom, or sides of the picture frame so that a threaded T-bar or hook on that screw engages a bracket anchored into the wall. By turning the screw the T-bar or hook moves the picture so that an inward wedge of the picture frame becomes locked into that bracket, or locked onto a second bracket anchored into the wall. A top and bottom screw system, with two wall brackets, enables the picture to be positioned vertically and horizontally. For this configuration the horizontal positioning is accomplished by sliding the picture sideways when the hooks are loose on the brackets. Loosening and tightening opposing screws makes vertical adjustments. When the screws are tightened the picture is locked into position.

A three-screw system can be used for leveling the picture as well as providing vertical and horizontal adjustability. For this configuration there are two top screws and one bottom screw. Again the hooks slide horizontally along the wall brackets and vertically by loosening the top hooks and tightening the bottom hook. Leveling of the picture is accomplished by adjusting the top screws.

Additionally, an electromechanical system can be used for holding the pictures securely flush against a wall. This configuration uses a motor or solenoid to drive the securing bracket into the frame connection. These devices would have external power supplies for their operation. The power is supplied through exterior connections on the frame.

A single aperture system can be composed of a frame with a single hole that can be lined up with the locking screw in the wall bracket. A screwdriver is inserted through the hole to move the locking bracket into the frame. After securing the picture a plug is inserted into the hole to prevent others from having access to the locking screw.

Latching means that employ springs can also be used with these frames. This configuration has the frame and wall brackets working together to support and lock the picture flush onto the wall. A top spring-loaded bracket pulls the picture in an upward direction while a bottom fixed bracket is interfacing with the bottom of the picture frame. When installing this configuration the top springs are worked until the bottom of the frame latches into the bottom bracket.

The various configurations for this invention have frame backs that have space for the supporting hardware and may also have specific frame configurations for attachment to the wall brackets. The purpose of these configurations is to hold the pictures flush against the wall and to resist most methods for unauthorized removal.

BRIEF DESCRIPTION OF THE DRAWINGS

FIG. 2*b* is a side elevational section of the device of FIG. 2*a*

FIG. 4*a* is a back elevational view looking away from the wall with the frame locked onto a bottom set of wall brackets.

FIG. 4*b* is a side elevational section of the device of FIG. 4*a*

DETAILED DESCRIPTION OF THE INVENTION

A picture frame and picture frame holder with interfacing wall hardware provide a means for hanging pictures so they are held flush against the wall. In addition to holding the picture flush many of the configurations also have adjustability features for leveling, and horizontal and vertical positioning.

Figure 1A:
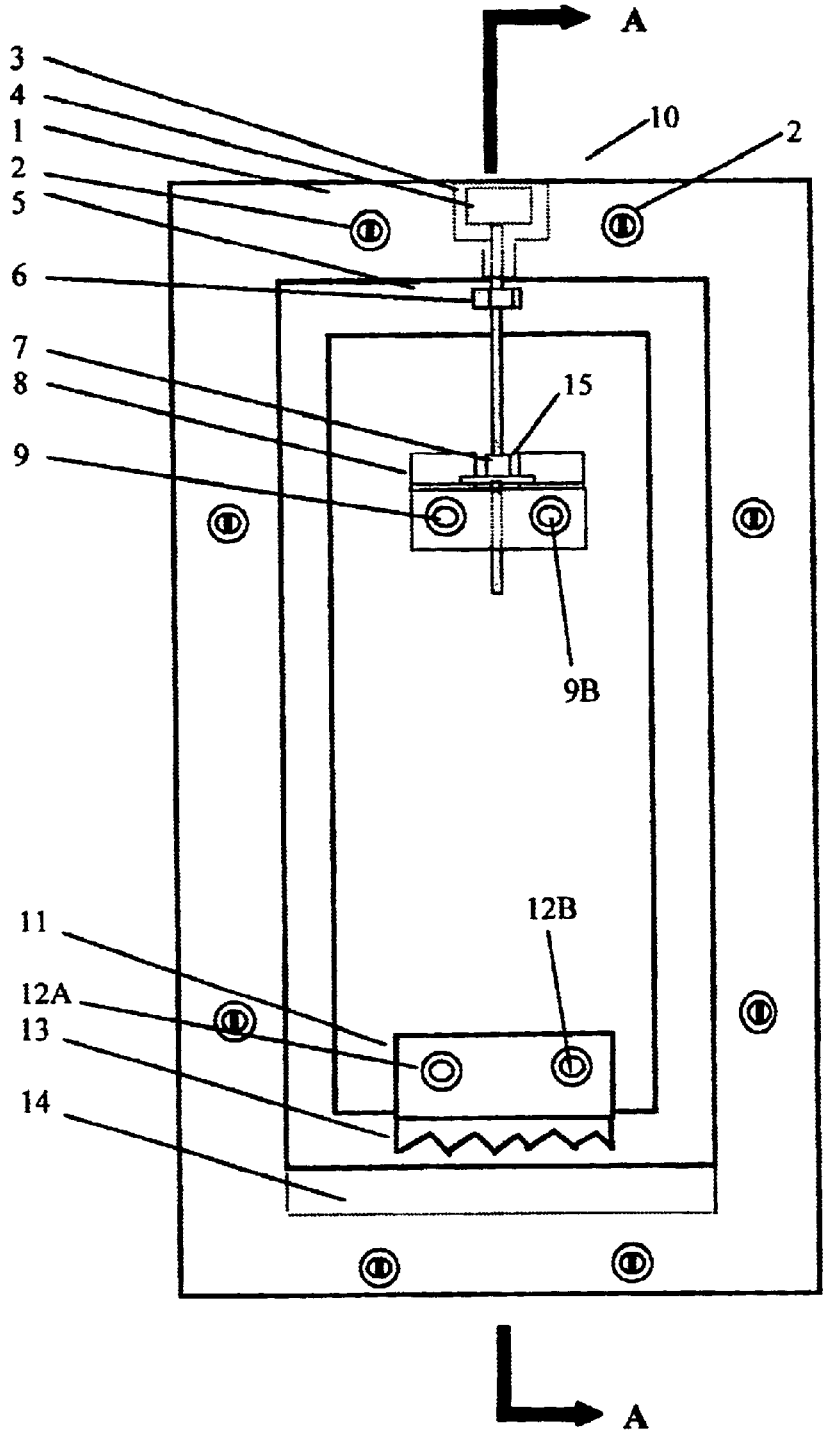
FIG. 1*a* is a back elevational view looking away from the wall with the frame T-bar engaged in the top wall bracket.
Figure 1B:
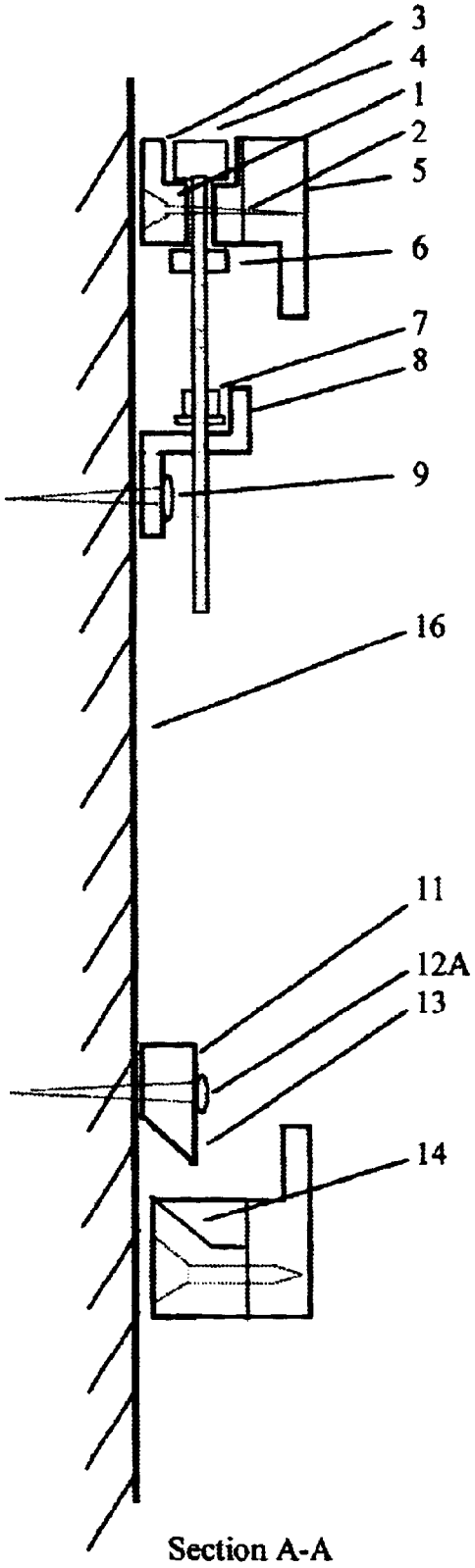
FIG. 1*b* is a side elevational section of the device of FIG. 1*a*

With reference to FIGS. 1*a* & 1*b*, in which like numerals represent like parts, FIGS. 1*a* & 1*b* show device 10 in position for use onto wall surface 16. Device 10 comprises a frame base 1, which is screwed into frame 5 with eight screws 2. In the top center of 1 is an aperture 3 with support screw 4 through it. Support screw 4 is locked in place with lock nut 6 on the inner edge of the frame base. The threaded T-bar 7 is also on screw 4 and lies against top wall bracket 8 which has a ledge and is anchored into wall 16 by screws 9*a* & 9*b*. The bottom wall bracket 11 is in the shape of a wedge and has teeth along the outer bottom edge 13, and is anchored to the wall with screws 12*a* & 12*b*. The top and bottom wall brackets are separated by a first distance, and the T-bar and beveled recess are separated by a second distance, The bottom wall bracket fits into the frame base bottom beveled recess 14. In order to mount the picture frame flush against the wall, the second distance is made larger than the first distance via the screw, and the screw is placed through the space so that the T-bar rests on the ledge. When support screw 4 is turned T-bar 7 pushes down on top wall bracket 8 and lock-nut 6 pushes the frame in an upward direction until the bottom wall bracket 11 is finally into the bottom beveled recess 14. At that point the frame base 1 is locked onto the wall and the sides are flush against the wall. Prior to locking the frame in place space 15 and the length of the T-bar provide some side adjustability.

Figure 2A:
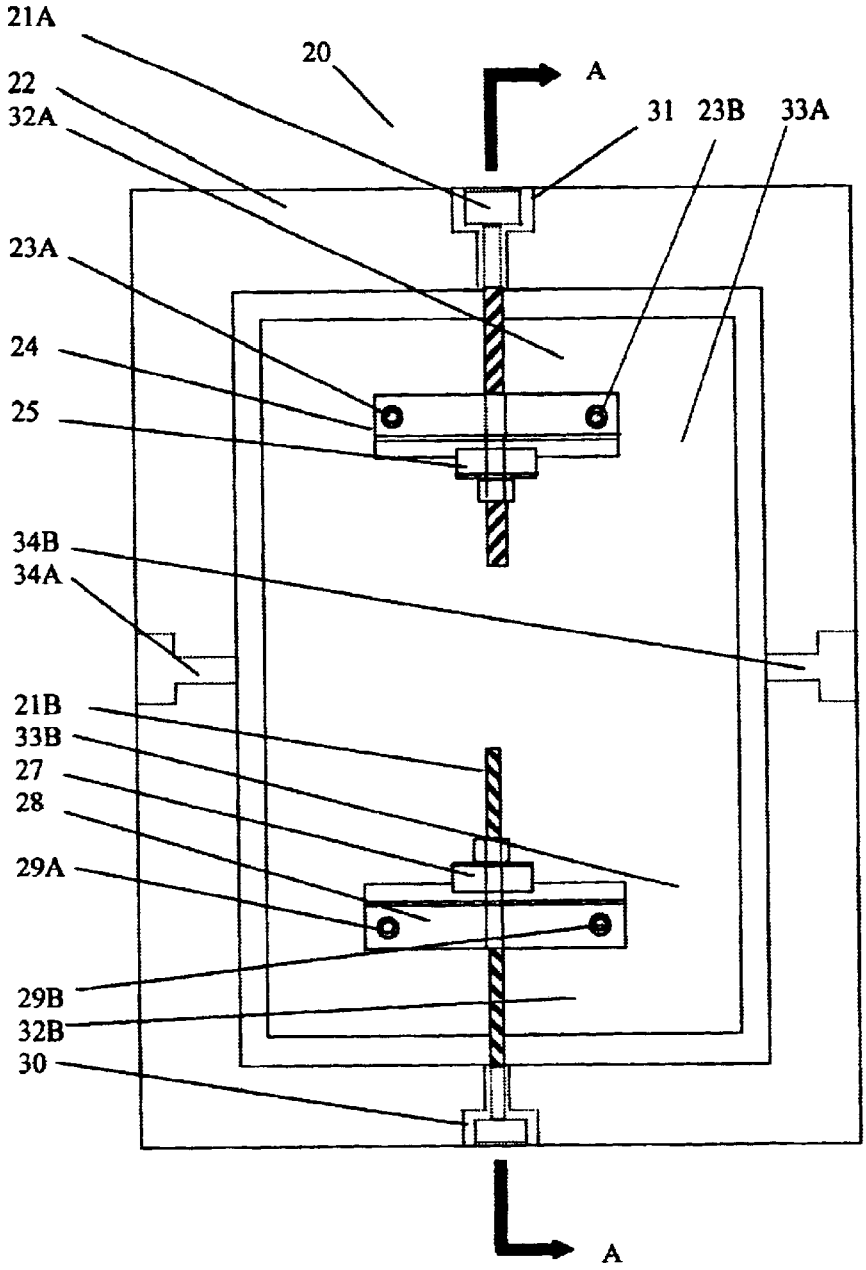
FIG. 2*a* is a back elevational view looking away from the wall with the hooks locked onto the wall bracket.

With reference to FIGS. 2*a* & 2*b* in which like numerals represent like parts, FIGS. 2*a* & 2*b* are showing device 20 in position for use, attached to wall surface 26. This picture frame 22 has top and bottom apertures 31 & 30 with top and bottom screws 21*a* & 21*b* through them. The screws 21*a* & 21*b* have threaded hooks 25 & 27 threadably engaged on them that are separated by a first distance and slidingly engaged onto the outer lip of wall brackets 24 & 28 that are separated by a second distance. Wall bracket 24 is anchored to wall 26 with screws 23*a* & 23*b* while wall bracket 28 is anchored with screws 29*a* & 29*b*. In order to mount the picture frame flush against the wall, the first distance is made smaller than the second distance via the screws, the bottom screw hook is placed over the lower lip, and the first distance is made substantially equal to the second distance via the screws so as to respectively lock the top and bottom screw hooks on the upper and lower lips. When the bottom screw 21*b* is loosened the picture frame drops down and increases space 32*b* while reducing space 32*a*. The length of the screws 21*a* & 21*b* and the spaces 32*a* & 32*b* set the limits on vertical adjustability. When the hooks 25 & 27 are loose the picture frame can be moved sideways to either increase or decrease spaces 33*a* & 33*b*. The length of this side adjustability is dependent upon the inside width of the frame and the length of the brackets 24 & 28.

Optional apertures 34*a* & 34*b* are for the addition of side locking screws. These screws would have their own hooks and wall brackets. With this configuration the picture would be locked horizontally as well as vertically.

Figure 3:
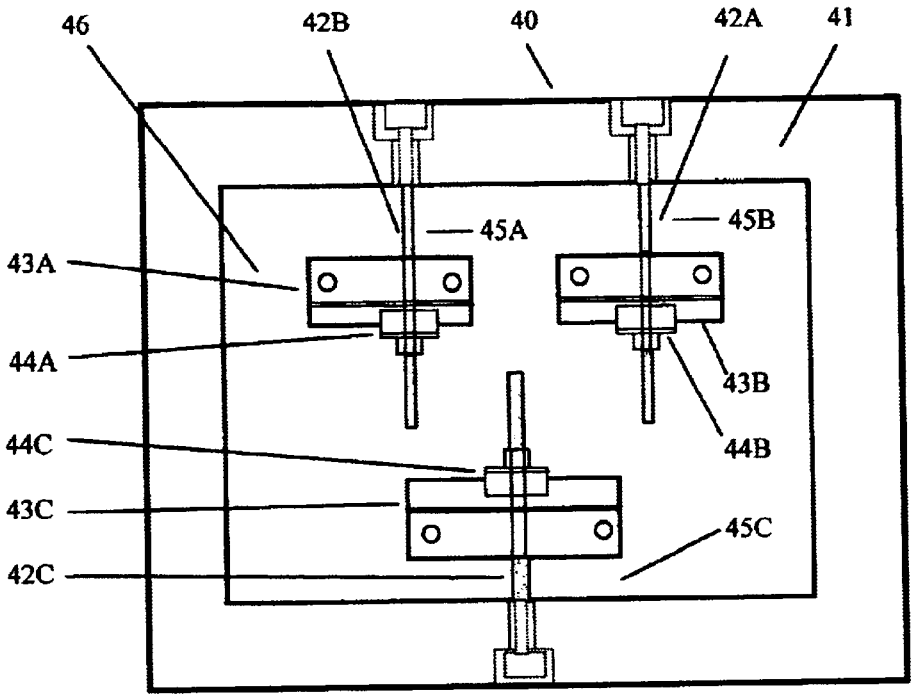
FIG. 3 is a back elevational view looking away from the wall with the hooks locked onto the wall bracket.

With reference to FIG. 3 showing device 40 similar to device 20 except that it has a third screw and support bracket. The frame 41 has apertures for screws 42*a*, 42*b* & 42*c* which each has a threaded hook 44*a*, 44*b* & 44*c* slidingly engaged onto wall brackets 43*a*, 43*b* & 43*c*. When the screws are turned spaces 45*a*, 45*b* & 45*c* are changed; and when slid sideways space 46 changes. By altering the positions of 44*a* & 44*b* the pitch of the picture can be altered until it is made level.

With reference to FIGS. 4*a* & 4*b*, in which like numerals represent like parts, FIGS. 4*a* & 4*b* are showing device 50 in position for use, attached to wall surface 54. The frame support 51 is screwed into the picture frame 52 with screws 53. At the bottom of the frame is an aperture for screw 55 that extends through wedge 57 and has T-bar 56 threadably engaged to it. Support wedges 58*a* & 58*b* are anchored to the wall 54 with screws 59 and butt up against wedge 57 on the top and frame support wedge area 60. Spaces 60 & 61 provide side adjustability and tightening screw 55 locks the picture flush onto the wall.

Figure 5:
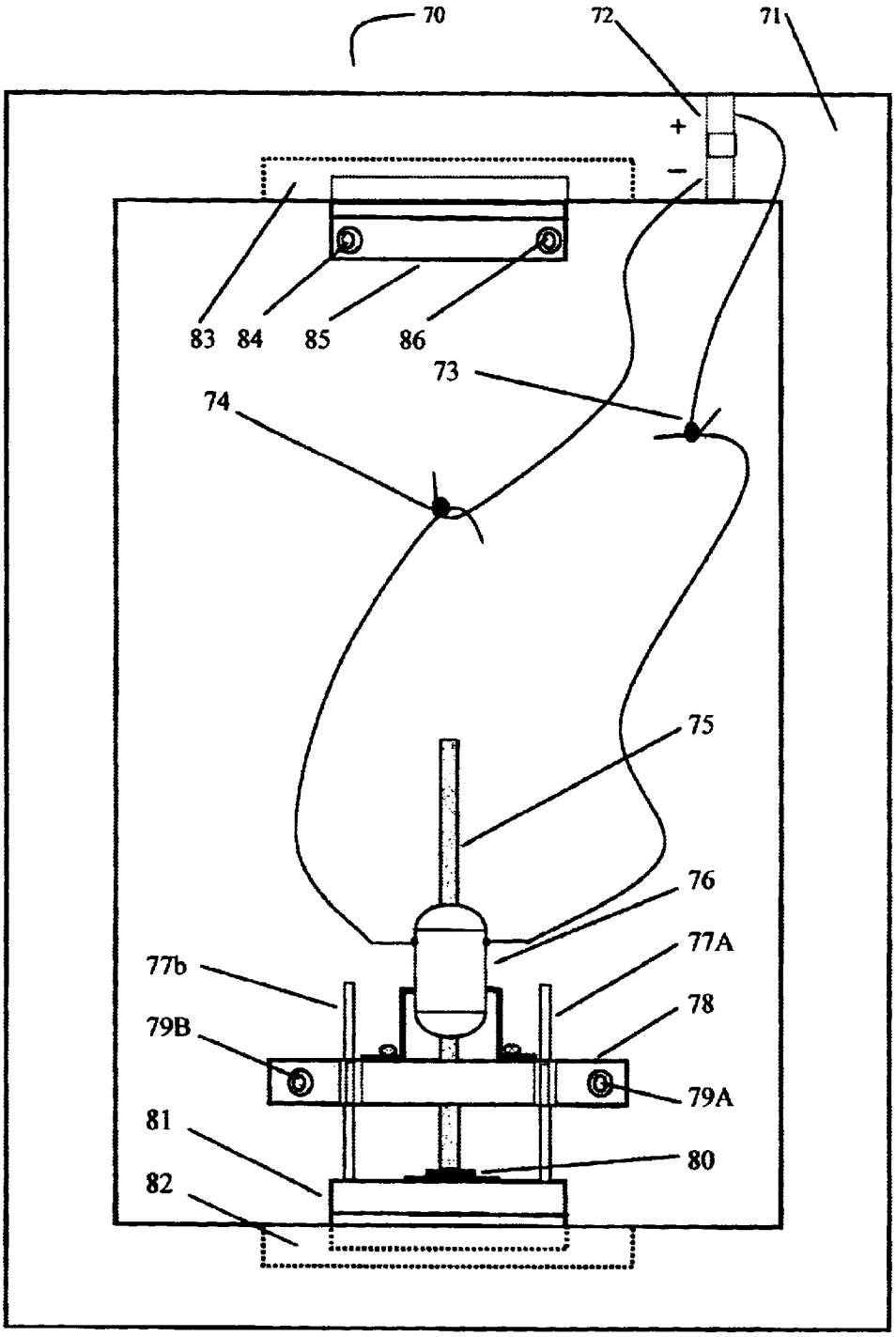
FIG. 5 is a back elevational view looking away from the wall with the frame locked onto the top wall wedge and the bottom motorized wedge.

With reference to FIG. 5 showing device 70, having picture frame 71 with top and bottom wedged recess areas at 83 & 82 supported by top wall wedge 85 anchored to wall with screws 84 & 86. The bottom locking wedge 81 is guided by pins 77*a* & 77*b* and attached to motor shaft 75 by bracket 80. The motor 76 is supported by wall bracket 78 that is anchored to the wall by screws 79*a* & 79*b*. The motor 76 is powered from the electrical connector 72 installed in the top of frame 71. When the frame is attached to the top wall wedge 85 the wire connections 73 & 74 are made. When dc power is supplied to electrical connector 72 the motor 76 drives the shaft 75 so that the bottom wedge 81 locks the picture onto the wall. When the power is reversed the motor retracts the wedge and the picture can be removed from the wall.

Figure 6:
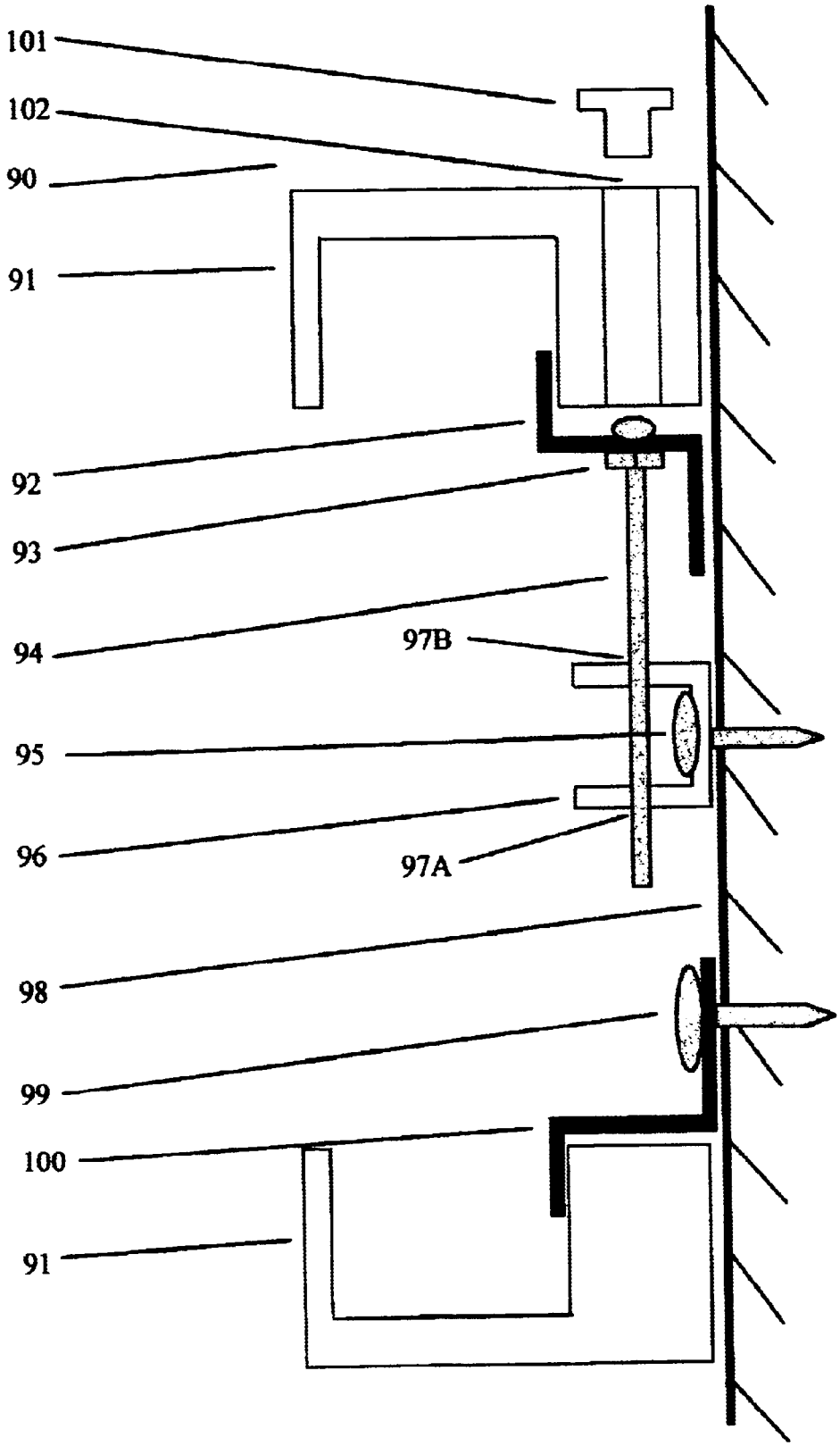
FIG. 6 is a side elevational section of a frame supported by a fixed bottom bracket and a raising top bracket beneath a single hole in the top of the frame.

With reference to FIG. 6 showing device 90 in position for use, with frame 91 having an aperture 102 for the insertion of a screwdriver to turn screw 94. When not being adjusted aperture 102 is closed with plug 101. The frame 91 is held in position by bracket 92, which is on locking screw 94 and held in place by lock nut 93. Adjusting screw 94 is threadably engaged at 97*a* & 97*b* to wall bracket 96 that is anchored to the wall 98 with screws 95. A bottom wall bracket 100 engages the bottom lip of the frame and is anchored to the wall with screw 99. When locking screw 94 is loosened the picture drops and can be removed from the wall.

Figure 7A:
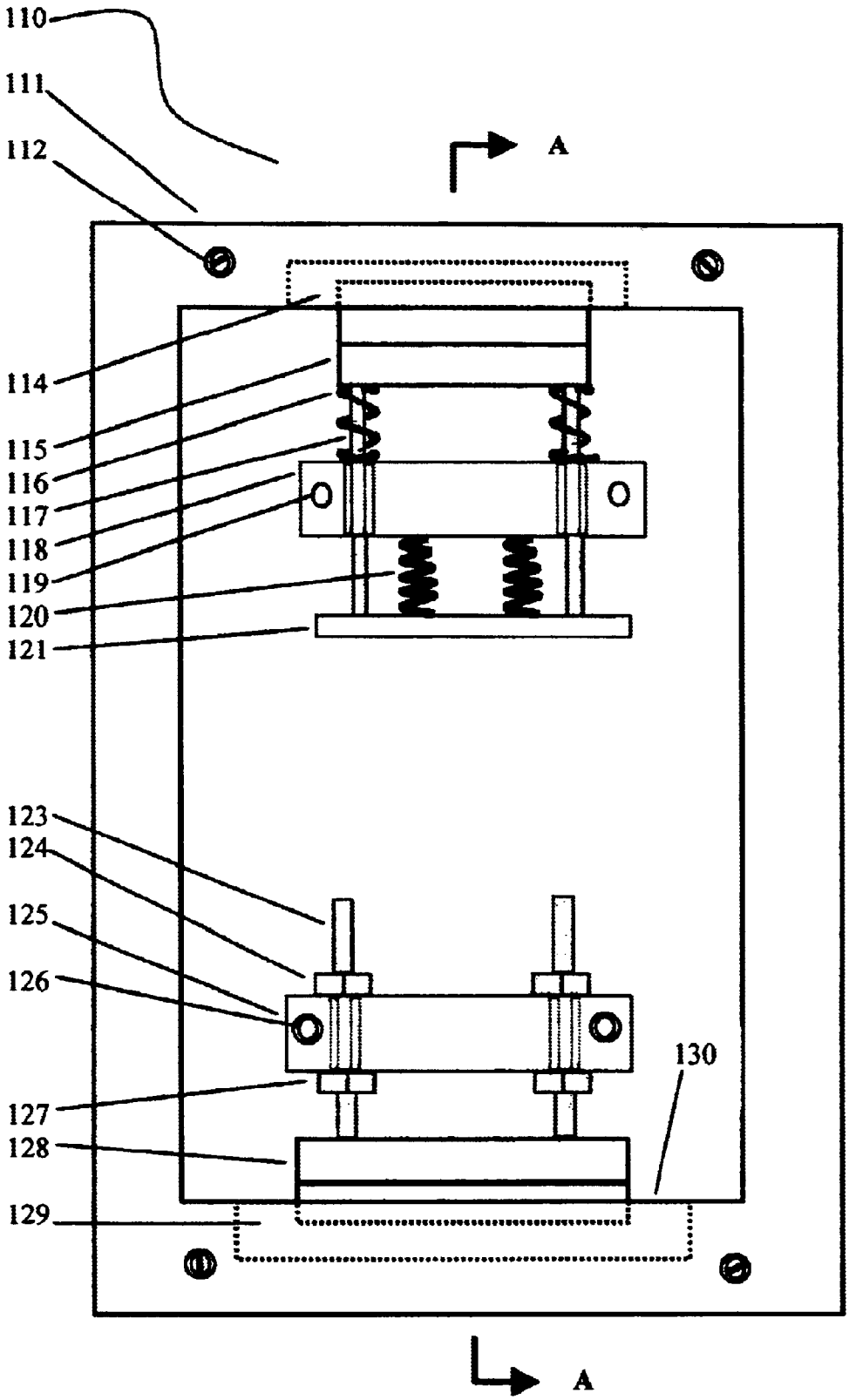
FIG. 7*a* is a back elevational view looking away from the wall with the frame locked into the top spring loaded wedge and the bottom adjustable wedge.
Figure 7B:
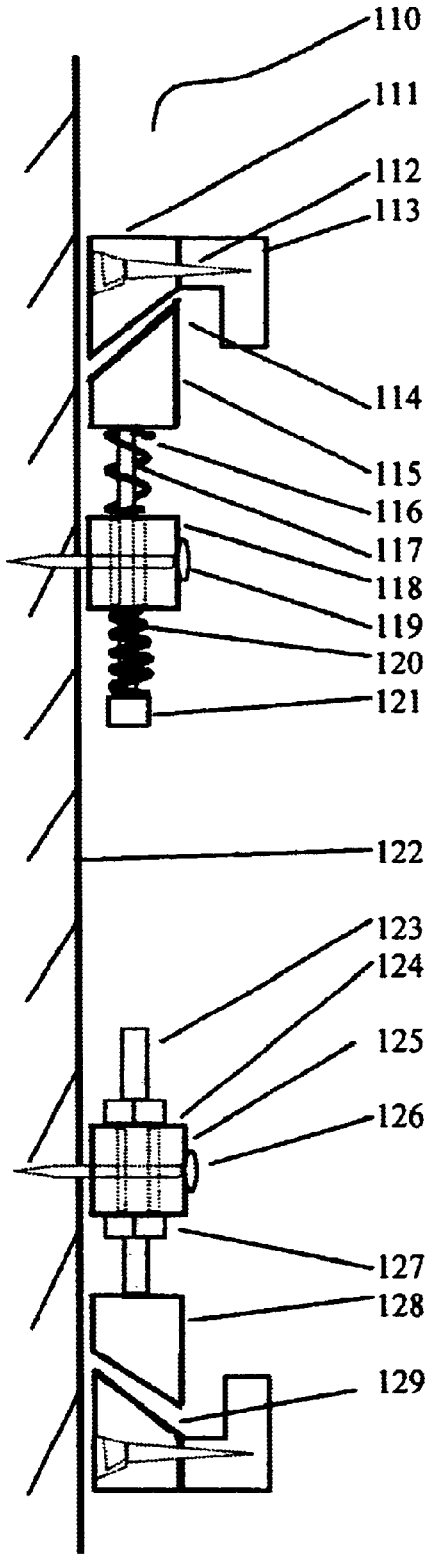
FIG. 7*b* is a side elevational section of the device of FIG. 8*a*

With reference to FIGS. 7*a* & 7*b*, in which like numerals represent like parts, FIGS. 7*a* & 7*b* are showing device 110 in position for use, attached to wall surface 122. Frame base 111 is screwed into picture 113 with screws 112. Frame base wedge area 114 interfaces with spring loaded wedge 115 that has guide pins 117 extending through apertures in wall bracket 118 and affixed to bar 121. Wall bracket 118 is anchored to wall 122 with screws 119. Compression springs 116 surround guide pins 117 and are between the spring-loaded wedge 115 and the wall bracket 118. Extension springs 120 are affixed to wall bracket 118 and bar 121. Bottom support wedge 128 interfaces with frame recess 129 and is affixed to bottom wall bracket 125 with adjusting screws 123 and nuts 124 and 127. Bottom wall bracket 125 is anchored to the wall with screws 126. Space 130 provides a measure of horizontal adjustability while the screws 123 provide leveling and vertical positioning. Pulling down on the frame allows the bottom support wedge 128 to extend beyond the lip of the frame recess 129 and permits removal of the frame. This embodiment is held flush against the wall and has no external indications of how it is held in place.

While the invention has been described above with respect to certain embodiments thereof, it will be appreciated that variations and modifications may be made without departing from the spirit and scope of the invention.

What is claimed is:

1. A combination of an adjustable positioning and locking system and a picture frame that allows the picture frame to be locked flush against a wall and removed from the wall, the system comprising:

at least one upper wall bracket separated from at least one lower wall bracket, the wall brackets comprising respective upper and lower lips;

top and bottom apertures in top and bottom portions of the picture frame and spaced inwardly from a back wall of the picture frame, each of the apertures extending-parallel to the longitudinal axis of the object;

top and bottom screws respectively located within top and bottom apertures, each of the screws having a hook threaded thereon;

wherein the hooks are adapted to be separated by a first distance;

wherein the at least one upper and at least one lower wall bracket are adapted to be separated by a second distance;

whereby in order to mount the picture frame flush against the wall:

a) the first distance is made smaller than the second distance via the screws, b) the bottom screw hook is placed over the lower lip, and c) the first distance is made substantially equal to the second distance via the screws so as to respectively lock the top and bottom screw hooks on the upper and lower lips;

whereby vertical adjustability of the frame is provided via adjustment of the top and bottom screws;

whereby horizontal adjustability of the frame is provided via loosening the top screw, moving the frame sideways on the lower lip, and subsequently tightening the top screw.

2. An apparatus for locking a picture frame flush against a wall, the apparatus comprising:

at least one top wall bracket separated from at least one bottom wedge-shaped wall bracket, the at least one upper wall bracket having a ledge and a space, and the at least one bottom wall bracket having an outer bottom edge;

a base having a top portion with an aperture and a bottom portion with a beveled recess, the base adapted to be screwed into the back of a picture frame;

a support screw located within the aperture;

a t-bar threaded onto the screw;

wherein the wall brackets are adapted to be separated by a first distance;

wherein the t-bar and the beveled recess are adapted to be separated by a second distance;

whereby in order to mount the picture frame flush against the wall:

a) the base is screwed onto the back of the picture frame, b) the second distance is made larger than the first distance via the screw, c) the screw is placed through the slot so that the t-bar rests on the ledge, and d) the screw is turned until the bottom edge locks into the beveled recess.

* * * * *